US006547701B1

(12) United States Patent
Eschenbach

(10) Patent No.: US 6,547,701 B1
(45) Date of Patent: Apr. 15, 2003

(54) ELLIPTICAL ABDOMINAL EXERCISE APPARATUS

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 111 days.

(21) Appl. No.: 09/615,813

(22) Filed: Jul. 13, 2000

(51) Int. Cl.[7] ..... A63B 69/16
(52) U.S. Cl. ..... 482/57; 482/64
(58) Field of Search ..... 482/51–53, 57–60, 482/62–65, 121, 122, 124, 126, 140

(56) References Cited

U.S. PATENT DOCUMENTS

| | | | | |
|---|---|---|---|---|
| 4,169,591 A | | 10/1979 | Douglas | 272/144 |
| 4,222,376 A | | 9/1980 | Praprotnik | 128/25 |
| 4,262,902 A | | 4/1981 | Dranselka | 272/132 |
| 4,601,464 A | | 7/1986 | Mousel | 272/73 |
| 4,739,984 A | | 4/1988 | Dranselka | 272/73 |
| 4,776,583 A | | 10/1988 | Jenniugs | 272/73 |
| 4,925,184 A | | 5/1990 | McJunkin | 272/73 |
| 4,979,737 A | | 12/1990 | Kock | 272/96 |
| D353,422 S | | 12/1994 | Bostic | D21/194 |
| 5,611,758 A | * | 3/1997 | Rodgers, Jr. | 482/57 |
| 5,618,247 A | * | 4/1997 | Perez | 482/60 |
| 5,707,321 A | | 1/1998 | Maresh | 482/57 |
| 5,743,050 A | | 4/1998 | Shibata | 52/27 |
| 5,836,855 A | * | 11/1998 | Eschenbach | 482/57 |
| 5,938,570 A | | 8/1999 | Maresh | 482/57 |
| 6,001,046 A | | 12/1999 | Chang | 482/57 |
| 6,077,197 A | | 6/2000 | Stearns et al. | 482/52 |
| 6,270,446 B1 | * | 8/2000 | Abelbeck et al. | 482/57 |

* cited by examiner

*Primary Examiner*—Nicholas D. Lucchesi
*Assistant Examiner*—Tam Nguyen

(57) ABSTRACT

The present invention relates to the field of pull/push exercise with an exercise machine that exercises the abdominal, back and arm muscles with the operator recumbent in the face upwards position. Foot contacts follow a closed elongate curve positioned above the recumbent operator. A linkage is provided for each foot contact in conjunction with a crank to drive a flywheel. Arm exercise is coordinated with the linkage.

27 Claims, 7 Drawing Sheets

ELLIPTICAL ABDOMINAL EXERCISE APPARATUS

BACKGROUND OF THE INVENTION

1. Field

The present invention relates to the field of recumbent cycling exercise apparatus. More particularly, the present invention relates to an exercise apparatus that exercises the abdominal, back and leg muscles with the operator prone on his back whereby the feet follow an elongate curve with pull/push movement.

2. State of the Art

The benefits of regular exercise to improve overall health, appearance and longevity are well documented in the literature. One of the most difficult muscle groups to exercise is the abdominals. For exercise enthusiasts the search continues for safe apparatus that provides exercise to tone the abdominals without back strain.

Many devices have appeared recently to aid the user in the performance of situps from a prone face-up position with the intent of easing back strain. Situps, even with assistive devices, have low appeal and often the devices find their way to a permanent storage area.

Devices to aid the sit-up movement such as Evans in U.S. Pat. No. 5,120,052, Steinmetz in U.S. Pat. No. 5,419,750 and Brown in U.S. Pat. No. 5,577,987, as just a few, that provide for a recumbent operator to contract the abdominals while raising the upper body with the aid of such device. Another group of abdominal exercise aids such as Boland in U.S. Pat. No. 5,759,138, Conner in U.S. Pat. No. 5,766,118 and Hern in U.S. Pat. No. 6,013,014 start in a seated posture and lean forward against the resistance of an apparatus.

Another abdominal exercise method developed by the Royal Canadian Air Force requires a person to start in a kneeling position on hands and knees, then push his body forward, sliding out along his hands until prone with arms extended. The exerciser then returns to the kneeling position by reversing the sliding action. This is a most difficult exercise and would not be embraced by the average exercise participant.

The simplest kneel-prone-kneel device is the classic exercise wheel. Shiek et al. in U.S. Pat. No. Des. 306,886 shows a pair of wheels rollably attached to a straight rod used for hand grip. Mattox in U.S. Pat. No. 5,261,866 adds elastic tubing to the handles where the knees hold the tubing while the operator is in the push mode to assist in the return mode. A spiral spring is added to the exercise wheel in R.O.C. Pat. 276503 and to a pair of wheels by Barbeau in U. S. Pat. No. 2,821,394.

Semi-recumbent cycles such as Chang in U.S. Pat. No. 6,001,046, Praprotnik in U.S. Pat. No. 4,222,376, Bostic et al. in U.S. Pat. No. Des. 353,422, Dranselka in U.S. Pat. No. 4,262,902 and Jennings in U.S. Pat. No. 4,776,583 show simple bicycle cranks to be operated from a seated position with the hip above or about the same level as the crank.

Another group of cycles intended to be ridden from the recumbent position such as Mousel in U.S. Pat. No. 4,601,464, Dranselka in U. S. Pat. No. 4,739,984, McJunkin, Jr. et al. in U.S. Pat. No. 4,925,184, Shibata in U.S. Pat. No. 5,743,050, Kock in U.S. Pat. No. 4,979,737 and Douglas in U.S. Pat. No. 4,169,591 are simple bicycle cranks attached to a bed by different means.

Recently several semi-recumbent cycles such as Stearns et al. in U.S. Pat. No. 6,077,197, Maresh in U.S. Pat. Nos. 5,707,321 and 5,938,570, Eschenbach in U.S. Pat. No. 5,836,855 and Rodgers, Jr. in U.S. Pat. No. 5,611,758 have added elliptical foot movement to a seated semi-recumbent operator.

One of the top 10 abdominal exercises listed by Club Industry Magazine, May, 2000, page 69, lists number 7 as the "Bicycle". The article gives the following directions: "lie on back and lift knees to a 90 degree angle from the floor; Bring the right knee in to the left elbow as the left leg extends; Repeat on the other side; Continue to alternate while keeping abdominals contracted". Observation of this exercise shows that the feet follow an elongate path instead of a circular bicycle path. The abdominals are exercised because the feet are moved towards the exerciser.

None of the prior art reviewed including samples above address the number 7 exercise with the feet moving along an elongate curve path while recumbent with knees bent above the upper body to drive a flywheel with load resistance. One of the objectives of the present invention is to provide a cycle movement for the feet where one foot pulls toward the operator against load resistance along an elongate curve path while the other foot pushes away from the upper body along the elongate path as the leg extends. Another objective of this invention is to provide pull/push apparatus motion which exercises the abdominals, back and leg muscles in a novel manner without back strain.

SUMMARY OF THE INVENTION

One objective of the present invention is to provide a pair of foot contacts that can be pulled by the abdominal muscles towards the recumbent operator. Another objective of the present invention is to provide means whereby either the instep or the bottom of the foot can be used by the prone operator to rotate a flywheel. Another objective of the present invention is to provide a heel support while the foot contact follows an elongate path during exercise. Another objective of the present invention is to provide handles for the hands during operation of the exercise apparatus. Another objective of the present invention is to provide an adjustable bench to vary the incline of the back of the operator.

The present invention is intended for a recumbent operator having back downward with knees bent where the feet move along a closed elongate curve path located above the torso of the operator. An adjustable bench is provided to support the back while the hip area is supported by a seat. A framework supports the seat, bench and a crank. The feet are positioned in a pair of foot contacts guided by a linkage to drive a flywheel through the crank, pulleys and a belt. An adjustable load resistance is imposed upon the flywheel.

The foot contacts are configured to allow the abdominal muscles to pull one foot towards a recumbent operator against the load resistance as the knee bends while the other foot pushes away from the operator as the leg extends. The feet alternately pull and push the foot contacts to exercise the leg muscles as well as the abdominals.

In the preferred embodiment, the foot contacts are pedals with foot straps located at one end of a foot engaging member that is pivotally connected to a crank intermediate the ends. The other end of the foot engaging member is pivotally connected to a rocker link which is pivotally connected to an adjustment arm. An actuator is connected to the adjustment arm and framework to allow the rocker pivot to be moved in order to change the motion of the foot contacts.

In an alternate embodiment, the rocker link of the preferred embodiment is replaced with a roller guide that moves in a track. A heel support and instep pad are part of the foot contact located at the end of the foot engaging members.

In another alternate embodiment, the crank is connected to one end of each foot engaging member with a rocker link connected intermediate the ends. Pedals with instep pads are pivotally connected to the other ends of the foot engaging member.

In yet another alternate embodiment, the rocker link of the previous embodiment is replaced with a slider link pivoted connected to the foot engaging member intermediate the ends constrained to move in a track. A bench adjustment means is included. Arm exercise is provided coordinated with the foot engaging member or crank.

Each embodiment includes foot contacts that move along various elongate curves above the recumbent operator that can be changed by a means for adjustment. Either the pedals can be relocated on the foot engaging members or the actuator can be adjusted to change the foot motion. The feet drive a flywheel with a pull/push motion against adjustable load resistance. Handles are provided to accommodate the hands of the operator. In any of the above embodiments, the bench can be adjusted to incline the back for the exercise of different muscles.

In an another alternate embodiment, a stablizer link is added to an elongated foot contact to control the angular movement of the foot contact.

Each of the embodiments shown contains a minimum number of elements that comprise the linkage to guide the foot contacts along a closed elongate curve path. It should be obvious that linkage systems having additional elements can also be used to guide the feet along an elongate path and are considered within the scope of the present invention.

Each of the embodiments provide pull/push apparatus motion which exercises the abdominals, back and leg muscles in a novel manner without back strain.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with addition specificity and detail through use of the accompanying drawings in which:

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, as represented in FIGS. 1 through 6, is not intended to limit the scope of the invention, as claimed, but is merely representative of the presently preferred embodiments of the invention.

Figure 1:
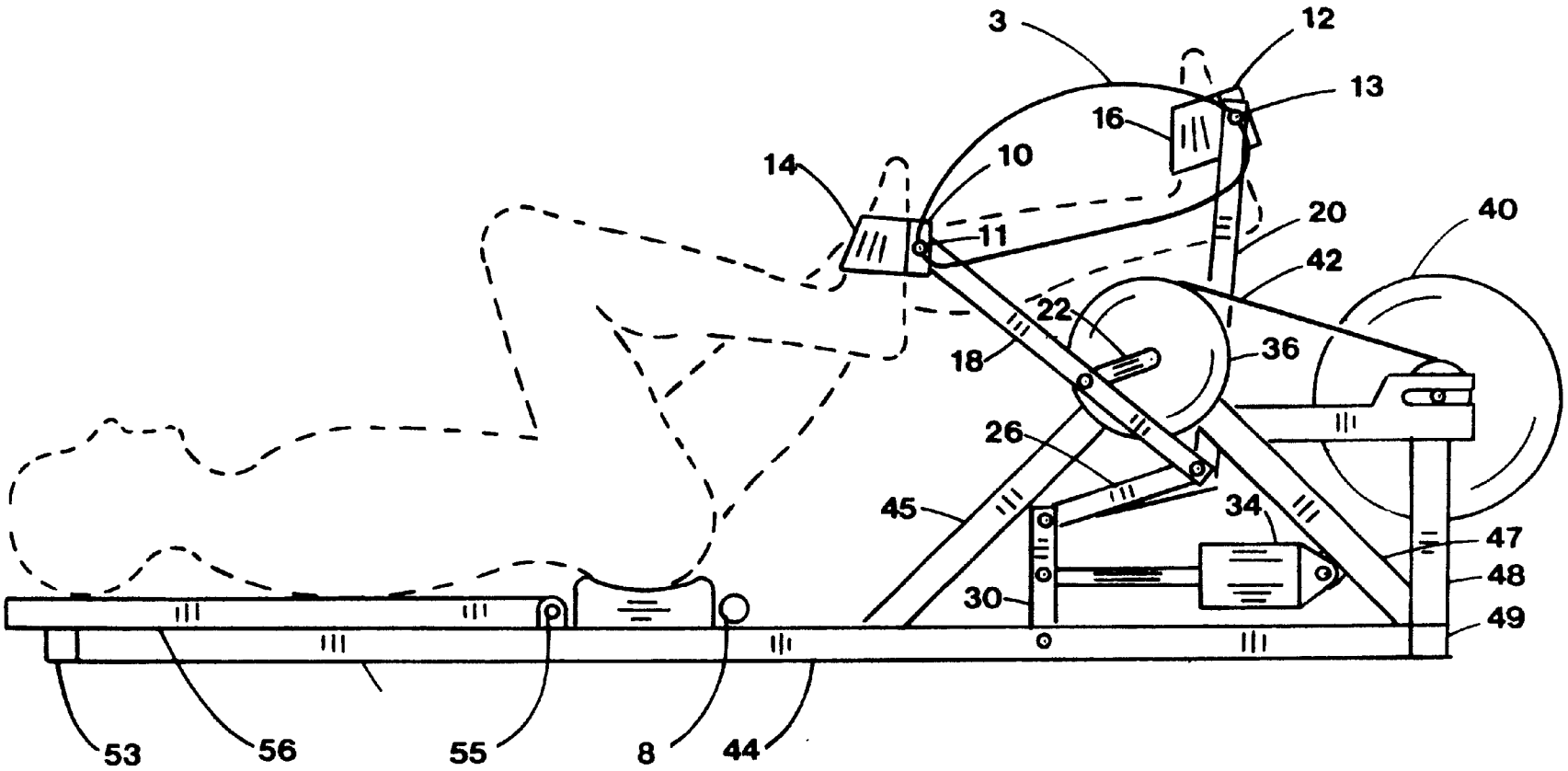
FIG. 1 is a side elevation view of the preferred embodiment of the present invention.
Figure 2:
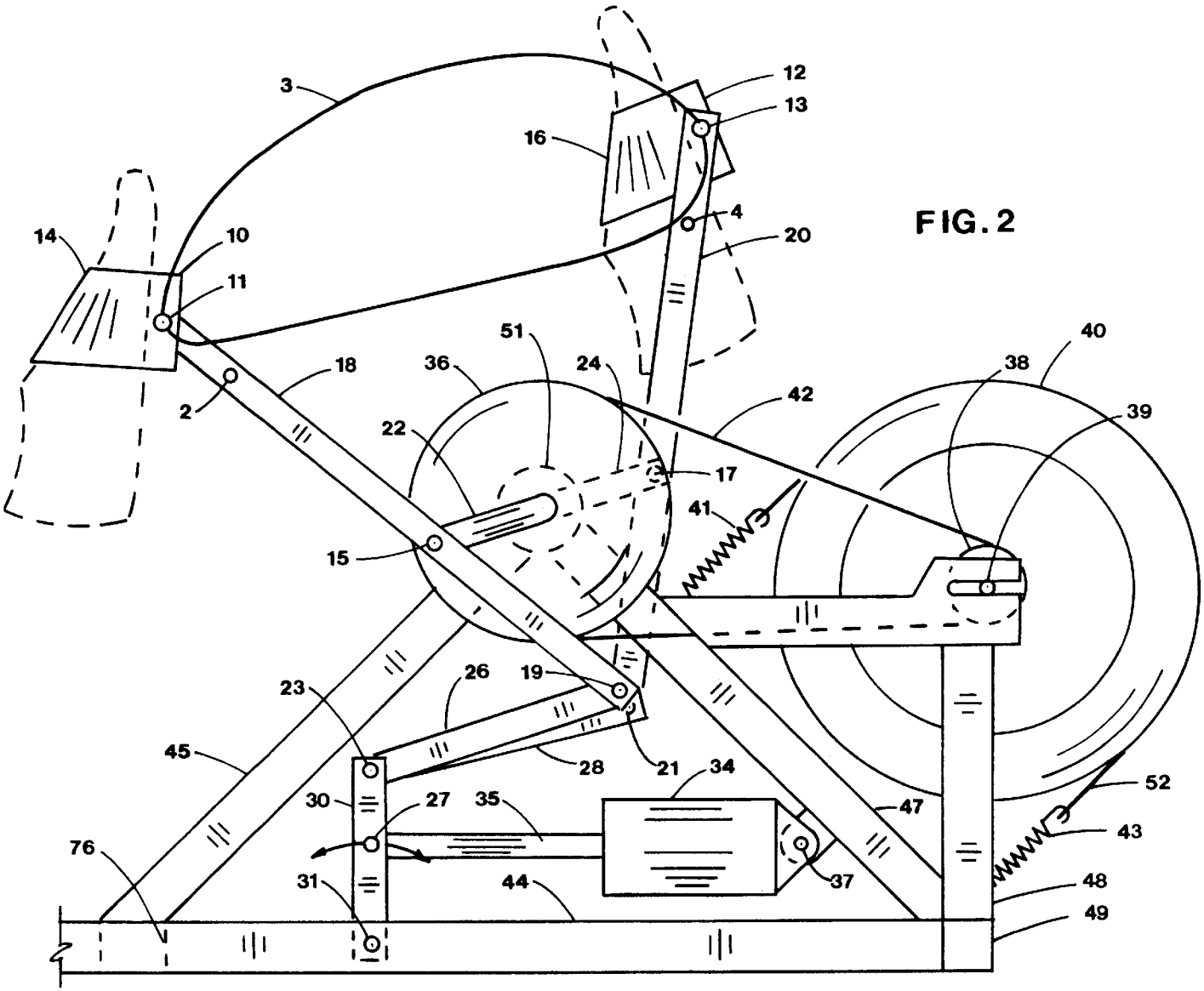
FIG. 2 is an enlarged side elevation of the preferred embodiment shown in FIG. 1.
Figure 3:
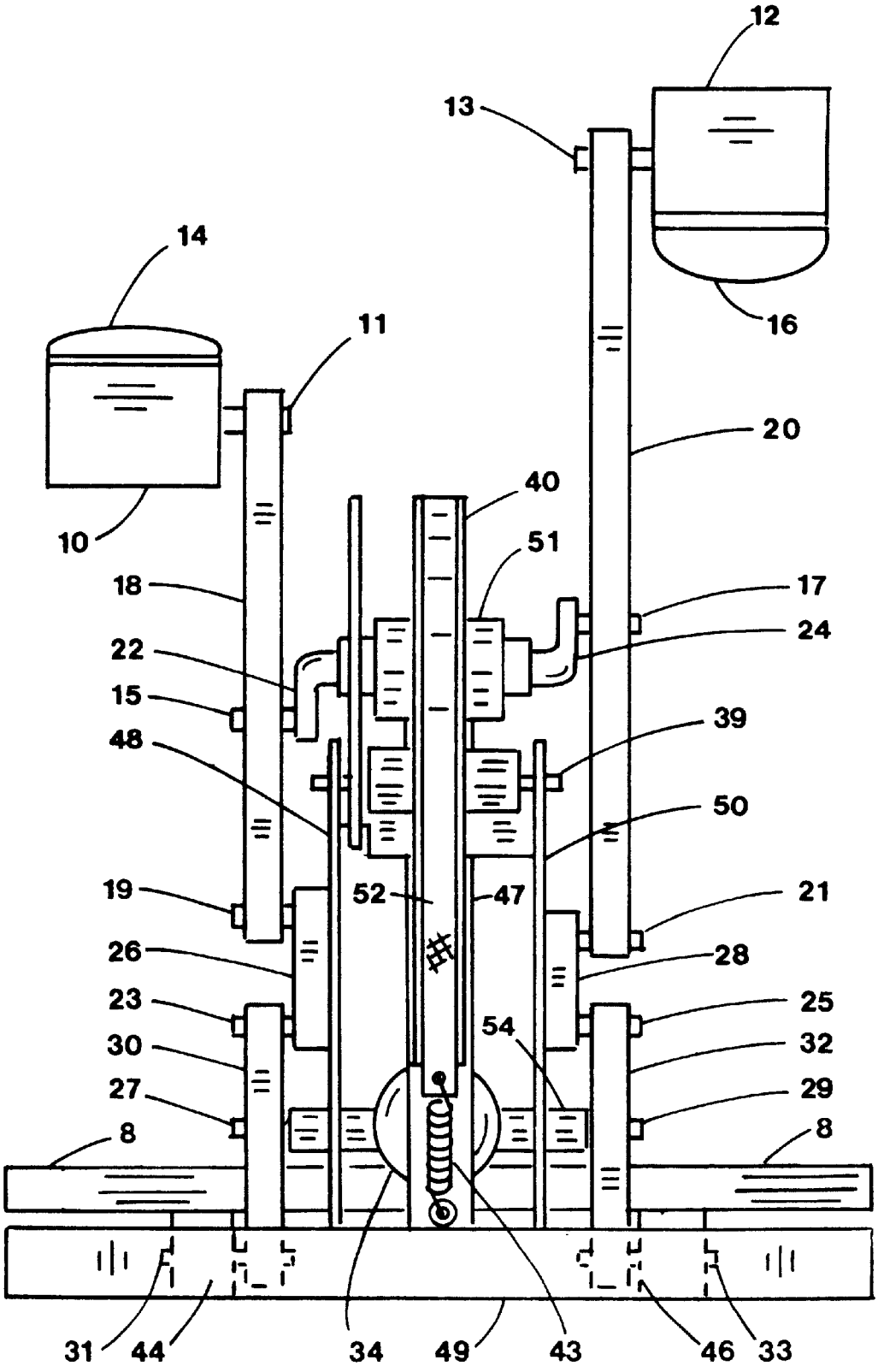
FIG. 3 is an end view of the preferred embodiment of FIGS. 1 and 2.

In the preferred embodiment shown in FIGS. 1,2 and 3, the foot contacts are shown as pedals 10,12 with the legs of the operator most bent and most extended. Pedals 10,12 are connected to foot engaging members 18,20 at pivots 11,13. Foot straps 14,16 allow the upper surface of the foot or instep to exert force on pivots 11,13 to work the abdominal muscles as pedal pivots 11,13 follow elongate curve 3. Additional pedal pivots 2,4 are provided to offer the operator an elongate curve (not shown) different from elongate curve 3.

Crank arms 22,24 are attached to foot engaging members 18,20 at pivots 15,17 and are connected approximately 180 degrees apart in bearing housing 51. Guides 26,28 are connected to foot engaging members 18,20 at pivots 19,21 and to adjustable arms 30,32 at pivots 23,25. Adjustable arms 30,32 are attached to frame members 44,46 at pivots 31,33 and to actuator shaft 35 at pivots 27,29. Actuator 34 is connected to frame member 47 at pivot 37. The incline of elongate curve 3 will change when the actuator 34 is changed.

Frame members 49,53 are in contact with the floor and are connected by frame members 44,46. Bearing housing 51 is connected to frame members 45,47 which are attached to crossover frame members 76,49. Frame members 48,50 support flywheel shaft 39.

Crank arms 22,24 are attached to pulley 36 which drives flywheel 40 through pulley 38 and belt 42. Load resistance is imposed upon flywheel 40 by friction belt 52 and springs 41,43. Friction belt 52 tension can be varied by any adjustment means (not shown) for variable load resistance.

The operator sits upon seat 58 and reclines with his back in contact with bench 56 shown horizontal in FIG. 1. The knees are bent so the feet can slide into foot straps 14,16 to contact pedals 10,12. Handle 8 is attached to frame members 44,46 for hand support during exercise. Flywheel 40 can be driven in either direction by force acting upon foot straps 14,16 or with force acting upon pedals 10,12.

Figure 4:
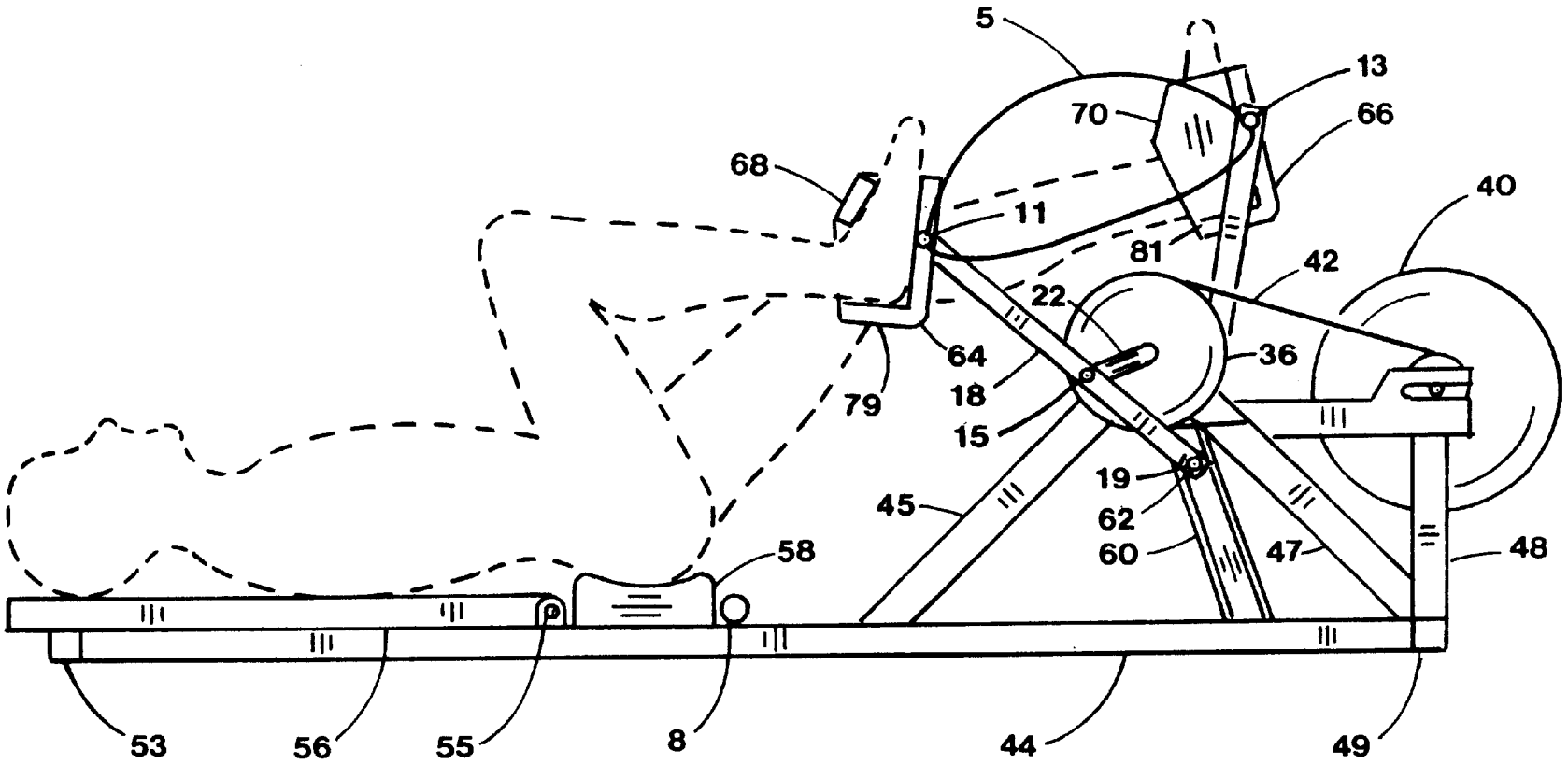
FIG. 4 is a side elevation view of an alternate embodiment of the present invention.

In the alternate embodiment of FIG. 4, guide 26 has been replaced with roller guide 62 pivoted at 19 which travels in slot 60. The same arrangement is provided for pivot 21 but not shown. Pedals 64,66 are connected to foot engaging members 18,20 at pivots 11,13 which follow elongate curve 5. Pedals 64,66 have heel supports 79,81 and instep pads 68,70 to facilitate the application of force upon instep pads 68,70 to exercise the abdominal muscles. Slot 60 may be relocated to change the incline of elongate curve 5 by adjustment means (not shown) similar to the preferred embodiment. The remainder of the apparatus is the same as the preferred embodiment.

Figure 5:
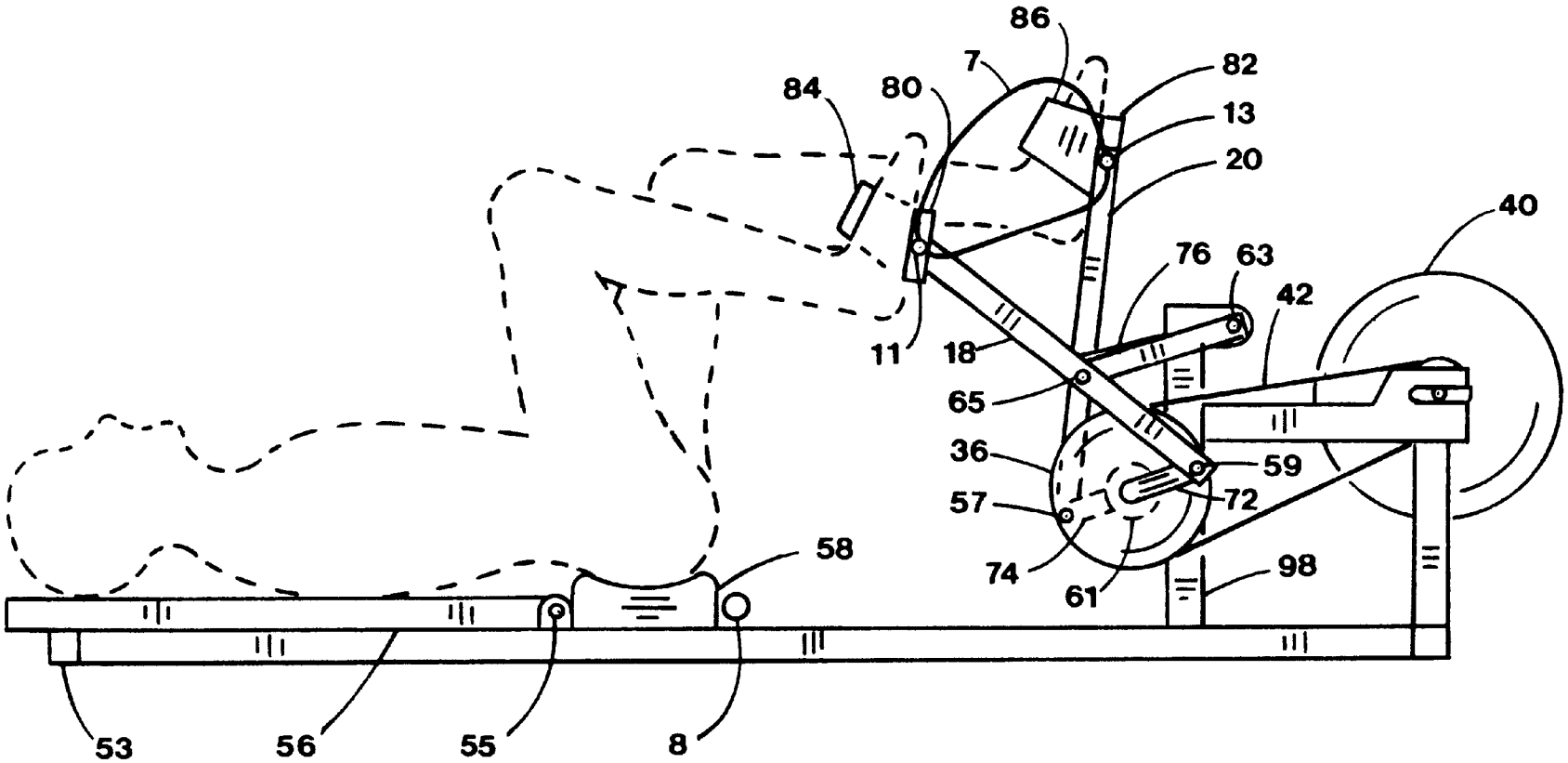
FIG. 5 is a side elevation of another alternate embodiment of the present invention.

In another alternate embodiment shown in FIG. 5, one end of foot engaging members 18,20 are connected to crank arms 72,74 at pivots 59,57. Rocker guide 76 is connected to foot engaging member 18 at pivot 65 and connected to frame member 98 at pivot 63. A similar guide for foot engaging member 20 is not shown. Pedals 80,82 have instep pads 84,86 which allow the abdominal muscles to pull the pedal pivots 11,13 along elongate curve 7 in either direction of rotation of flywheel 40. Guide pivot 63 can be moved similar to the preferred embodiment to change the orientation of elongate curve 7. The remainder of the apparatus is the same as the preferred embodiment.

Figure 6:
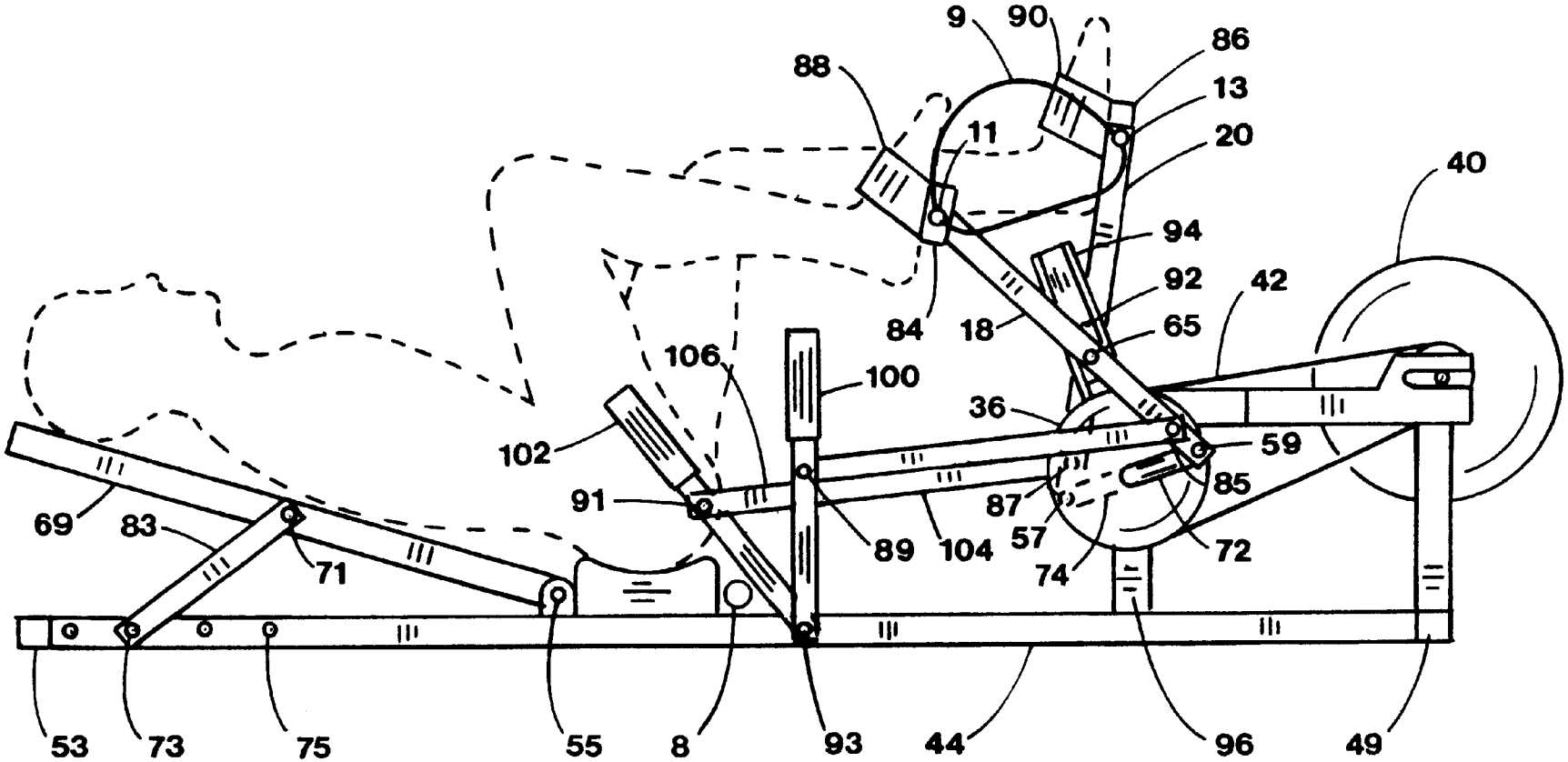
FIG. 6 is a side elevation of another alternate embodiment of the present invention.

In another alternate embodiment shown in FIG. 6, guide 76 is replaced with slider 92 connected to foot engaging member 18 at pivot 65. Slider 62 moves in slot 94 which is attached to frame member 96. A similar slider/slot arrangement is provided for foot engaging member 20 but not shown. Pedals 84,86 are connected to foot engaging members 18,20 at pivots 11,13 which follow elongate curve 9. The orientation of elongate curve 9 can be changed by relocating slot 94. Foot straps 88,90 allow the abdominal muscles to pull pedals 84,86 towards the operator. Bench 69 is shown inclined about pivot 55 with brace 83 connected to screws 71,73. Other screws positions 75 allow the bench incline to vary.

Handles 100,102 are connected to frame members 44,46 at pivot 93 for arm exercise. Connecting links 104,106 connect handles 100,102 at pivots 89,91 and foot engaging members 18,20 at pivots 85,87. In this embodiment, the arm is extended while the corresponding knee is bent. It should be understood, other forms of hand to foot coordination are considered within the scope of the present invention. The remainder of the apparatus is the same as the preferred embodiment.

Figure 7:
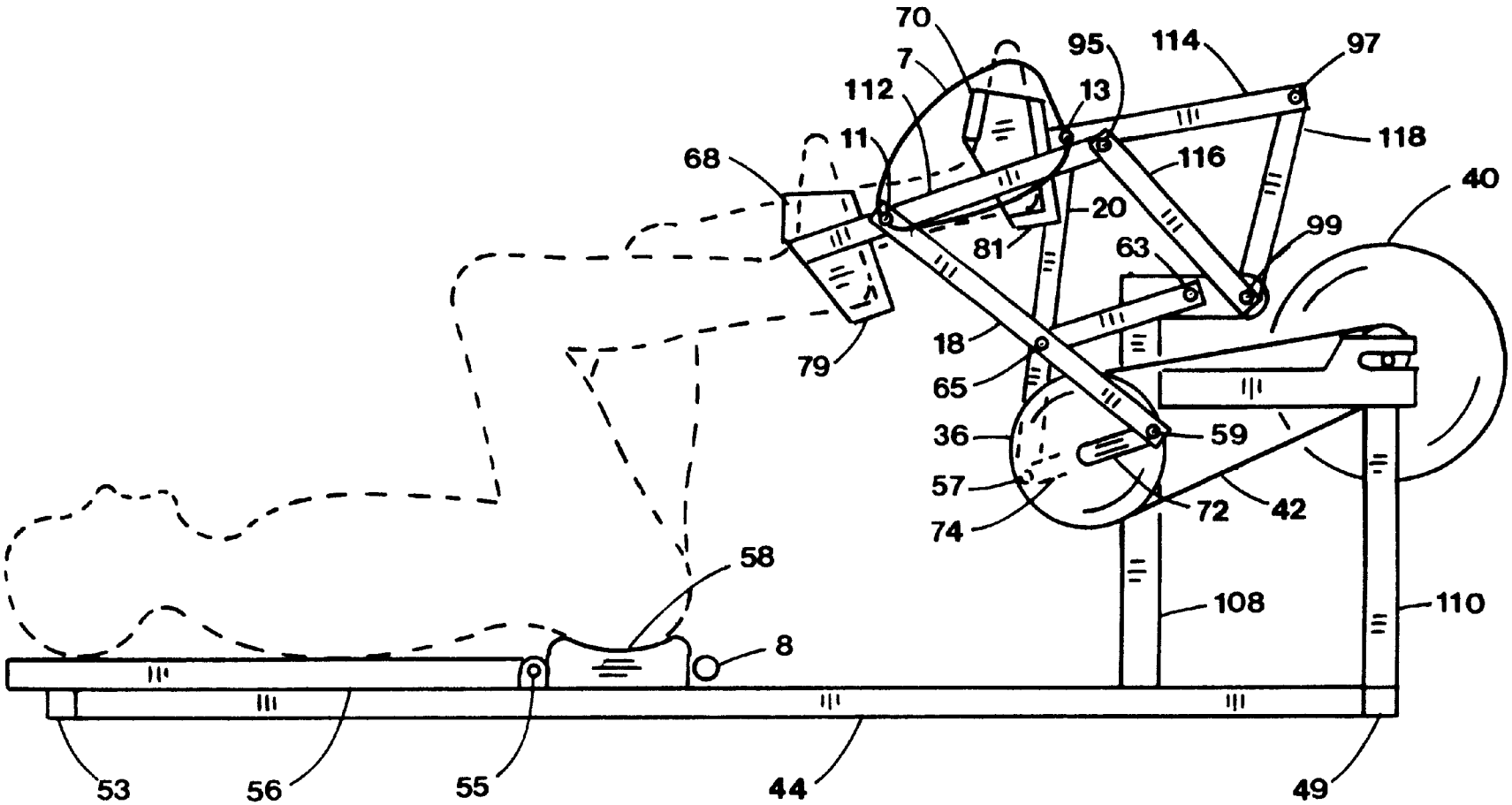
FIG. 7 is a side elevation of another alternate embodiment of the present invention.

In FIG. 7, elongate foot contacts 112,114 are connected to foot engaging members 18,20 at pivots 11,13. Stablizer links 116,118 are connected to elongate foot contacts 112,114 at pivots 95,97 and to the frame member 108 at pivot 99. Frame members 108,110 are attached to frame members 44,46. Instep pads 68,70 and heel supports 79,81 are attached to elongate foot contacts 112,114. Stabilizer links 116,118 control the angular movement of elongate foot contacts 112,114 and can be used with any of the previous embodiments. The remainder of the apparatus is the same as the preferred embodiment.

Each of the embodiments provide pull/push apparatus motion which exercises the abdominals, back and leg muscles in a novel manner without back strain. Arms may also be exercised.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine for allowing a recumbent operator to move the feet through a closed elongate curve comprising;

a framework, said framework configured to be supported by a generally horizontal surface;

a crank rotatably connected to said framework at a crank bearing housing, said crank projecting outwardly therefrom on both sides thereof;

a pair of foot engaging members, each said foot engaging member pivotally connected to said crank;

a pair of guides, each said guide connected to corresponding said foot engaging member at a guide pivot, wherein said guide pivot has back and forth movement;

a pair of foot contacts, each said foot contact pivotally connected to corresponding said foot engaging member proximate one end of said foot engaging member;

said foot contact configured to move relative to said framework when the foot of said recumbent operator is rotating said crank whereby said foot contact follows said closed elongate curve with the hip of said recumbent operator positioned below said crank bearing housing.

2. An exercise machine according to claim 1 wherein said guide is a rocker link, said rocker link connected to said foot engaging member at said guide pivot and to an adjustable arm.

3. An exercise machine according to claim 1 further comprising a means for adjustment, said means for adjustment operably associated with said guide whereby said closed elongate curve may be changed.

4. An exercise machine according to claim 3 wherein said means for adjustment comprises an actuator, said actuator operably associated with said guide and said framework.

5. An exercise machine according to claim 3 wherein said means for adjustment comprises an alternate pivot location, said alternate pivot location operably associated with said foot contact and said foot engaging member.

6. An exercise machine according to claim 1 further comprising a handle, said handle positioned on said framework to support the hands of said operator.

7. The exercise machine according to claim 1 wherein said crank can be rotated in either direction of rotation by said foot contacts.

8. The exercise machine according to claim 1 further comprising a load resistance operably associated with said crank.

9. The exercise machine according to claim 1 further comprising a flywheel, said flywheel operably associated with said crank.

10. The exercise machine according to claim 1 further comprising a pair of instep contacts, each said instep contact connected to said foot contact wherein said instep contact allows the abdominal muscles of the operator to move said foot contact towards the operator.

11. The exercise machine according to claim 10 wherein said instep contact comprises a strap, said strap connected to said foot contact.

12. The exercise machine according to claim 1 wherein said foot contacts comprise a pair of pedals, each said pedal pivotally connected to said foot engaging member.

13. The exercise machine according to claim 1 further comprising a bench to support the back of said operator, said bench connected to said framework.

14. An exercise machine for allowing a recumbent operator to move the feet through a closed elongate curve comprising;

a framework, said framework configured to be supported by a generally horizontal surface;

a crank rotatably connected to said framework, said crank projecting outwardly therefrom on both sides thereof;

a pair of foot engaging members, each said foot engaging member pivotally connected to said crank intermediate the ends of said foot engaging member;

a pair of guides, each said guide connected to corresponding said foot engaging member at a guide pivot positioned at one end of said foot engaging member, wherein said guide pivot has back and forth movement;

a pair of foot contacts, each said foot contact pivotally connected to corresponding said foot engaging member proximate the other end of said foot engaging member;

said foot contact configured to move relative to said framework when the foot of said recumbent operator is rotating said crank whereby said foot contact follows said closed elongate curve with the hip of said recumbent operator positioned below complete path of said closed elongate curve.

15. An exercise machine according to claim 14 wherein said guide is a rocker link, said rocker link connected to said foot engaging member at said guide pivot and an adjustable arm.

16. An exercise machine according to claim 14 further comprising a handle, said handle positioned on said framework to support the hands of said operator.

17. The exercise machine according to claim 14 further comprising a load resistance operably associated with said crank.

18. The exercise machine according to claim 14 further comprising a flywheel, said flywheel operably associated with said crank.

19. The exercise machine according to claim 14 wherein said foot contacts comprise a pair of pedals, each said pedal pivotally connected to said foot engaging member.

20. The exercise machine according to claim 14 wherein each said guide has a means for adjustment whereby said closed elongate curve can be moved relative to the position of said operator.

21. The exercise machine according to claim 14 further comprising a pair of foot straps, each said foot strap connected to said foot contact wherein said foot strap allows the abdominal muscles of the operator to move the foot contact toward the operator.

22. The exercise machine according to claim 14 further comprising a bench to support the back of said operator, said bench connected to said framework.

23. An exercise machine for allowing a recumbent operator to move the feet through a closed elongate curve comprising;

a framework, said framework configured to be supported by a generally horizontal surface;

a crank rotatably connected to said framework, said crank projecting outwardly therefrom on both sides thereof;

a pair of foot engaging members, each said foot engaging member pivotally connected to said crank intermediate the ends of said foot engaging member;

a pair of guides, each said guide connected to corresponding said foot engaging member at a guide pivot positioned at one end of said foot engaging member, wherein said guide pivot has back and forth movement;

a pair of foot contacts, each said foot contact pivotally connected to corresponding said foot engaging member proximate the other end of said foot engaging member and said foot contact configured to receive force from the upper portion of the foot of the operator;

said foot contact configured to move relative to said framework when the foot of said recumbent operator is rotating said crank whereby said foot contact follows said closed elongate curve with the hip of said recumbent operator position below the complete path of said closed elongated curve with the hip of saiid recumbent operator positioned below the complete path of said closed elontgate curve.

24. An exercise machine according to claim 23 wherein said guide is a rocker link, said rocker link connected to said foot engaging member at said guide pivot and an adjustable arm.

25. An exercise machine according to claim 23 further comprising a handle, said handle positioned on said framework to support the hands of said operator.

26. The exercise machine according to claim 23 wherein said foot contact comprises a pair of foot straps, each said foot strap connected to said foot contact wherein said foot strap allows the abdominal muscles of the operator to move the foot contact toward the operator.

27. The exercise machine according to claim 23 further comprising a bench to support the back of said operator, said bench pivotally connected to said framework.

* * * * *